United States Patent [19]

Betrue, Sr.

[11] 4,202,149

[45] May 13, 1980

[54] CONSTRUCTION DEVICE

[76] Inventor: Norman A. Betrue, Sr., 3937 Feemster, Visalia, Calif. 93277

[21] Appl. No.: 905,167

[22] Filed: May 12, 1978

[51] Int. Cl.[2] ..... E04B 1/38

[52] U.S. Cl. ..... 52/699; 52/713; 52/293

[58] Field of Search ..... 52/699, 701, 713, 712, 52/715, 293, 295

[56] References Cited

U.S. PATENT DOCUMENTS

| | | | |
|---|---|---|---|
| 1,423,991 | 7/1922 | Brooks | 52/370 |
| 2,110,863 | 3/1938 | Barnett | 52/295 |
| 3,413,773 | 12/1968 | Fitzgerald | 52/295 |
| 3,422,585 | 1/1969 | Dismukes | 52/295 |
| 3,494,090 | 2/1970 | Allen | 52/370 |
| 3,889,441 | 6/1975 | Fortine | 52/370 |

FOREIGN PATENT DOCUMENTS

| | | | |
|---|---|---|---|
| 400596 | 10/1933 | United Kingdom | 52/370 |

OTHER PUBLICATIONS

Popular Mechanics, Aug. 1964, p. 141.

*Primary Examiner*—James A. Leppink
*Assistant Examiner*—Henry E. Raduazo
*Attorney, Agent, or Firm*—Huebner & Worrel

[57] ABSTRACT

A device for securing a work object on a concrete structure in cooperation with a form used in pouring the structure, the device having an anchor member with a head portion; and a fastening member having portions for individually interconnecting the head portion of the anchor member and the form in a first attitude prior to pouring and the head portion and the work object in a second attitude subsequent to pouring.

10 Claims, 8 Drawing Figures

CONSTRUCTION DEVICE

BACKGROUND OF THE INVENTION

1. Field Of The Invention

The present invention relates to a construction device and more particularly to such a device which is useful in securing work objects to concrete foundations and the like operating in one attitude precisely to position an anchor member for embedding in the concrete at the time the concrete is poured and in a second attitude to secure the work object, such as a post, column, framing, or the like, to the anchor member after the concrete has been poured.

2. Description Of The Prior Art

It is frequently necessary in construction to secure structures such as posts, columns, pillars, framing or other work objects on concrete foundations or similar structures. Prior art practice calls for bolts, conventional brackets, or the like to be embedded in the concrete at the time the concrete is poured for use thereafter in securing the work objects to the foundation. This practice presents considerable and heretofore unresolved difficulties with conventional devices since precise positioning of such bolts or brackets is essential if the work objects are to be precisely positioned and properly mounted.

Nowhere is this problem more acute than in home and building construction. Conventional practice calls for exterior wall frames to be assembled on the ground adjacent to the concrete foundation and subsequently to be erected on the foundation by the extension of bolts, embedded in the concrete, through holes drilled in the frames. Since no convenient means exists for precisely positioning the bolts, they are often not properly positioned. Since the bolts project above the upper surface of the foundation, they are frequently bent or otherwise damaged during construction to such a degree as to make them unusable. Furthermore, since the frame is assembled a distance away from the foundation, it is extremely difficult precisely to position the holes for receipt of the bolts. The result is that the bolts are often not used in a manner consistent with acceptable building practices and the framing is weakened by improperly positioned and excessive numbers of holes. In any event, the effect is that of weakening the overall strength of the structure, of increasing the costs of contruction, of delaying construction and of generally interferring with construction.

Therefore, it has long been known that it would be desirable to have a construction device which permits the precise positioning of anchor members to be embedded in concrete foundations and the like and which can be used thereafter for rapidly securing work objects to the anchor members without the need for painstaking adjustment or in any way compromising the structural integrity of the structure being built.

SUMMARY OF THE INVENTION

Therefore, it is an object of the present invention to provide an improved construction device.

Another object is to provide such a device which is adaptable for use in virtually any situations in which a work object must be secured to a rigid structure formed by solidifying a flowable mass.

Another object is to provide such a device which can be operated in cooperation with construction forms precisely to position an anchor member relative to the form, which is adapted to receive poured concrete thereabout so as to position a connective portion thereof at the surface of the concrete structure so formed, which can thereafter be modified to anchor a work object to the connective portion in the precise position desired and which has an operational strength superior to any conventional device of comparable cost.

Another object is to provide such a device which in a first attitude serves precisely to position the anchor member for the pouring of concrete thereabout and simultaneously forms a groove in the concrete structure so formed leading from the edge thereof to the connective portion of the anchor member for receipt of a portion of a fastening member employed in interconnecting the connective portion and the work object.

Another object is to provide such a device which can readily be modified to increase the restraining capability of the device at minimal expense and difficulty.

Another object is to provide such a device which facilitates the assembly and erection of wall frames on concrete foundations and the like.

Another object is to provide such a device which has superior structural characteristics and yet can be sold at a price competitive with conventional devices.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
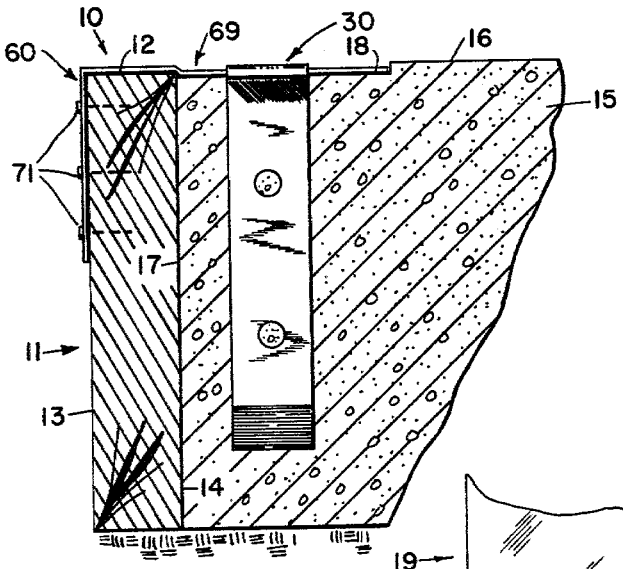
FIG. 1 is a fragmentary vertical section of a concrete foundation subsequent to pouring of the concrete within the forms and showing the device of the present invention mounted in a first attitude for precise positioning of the anchor member thereof.

Referring more particularly to the drawings, the construction device of the present invention is generally indicated by the numeral 10. The device is shown in its first attitude in FIG. 1 wherein a construction form 11 has an upper edge surface 12. The form has an exterior side surface 13 and an opposite interior side surface 14. It will be understood that the form is secured in the upright position shown in FIG. 1 using suitable metal stakes or the like, not shown, in accordance with conventional practice.

Figure 2:
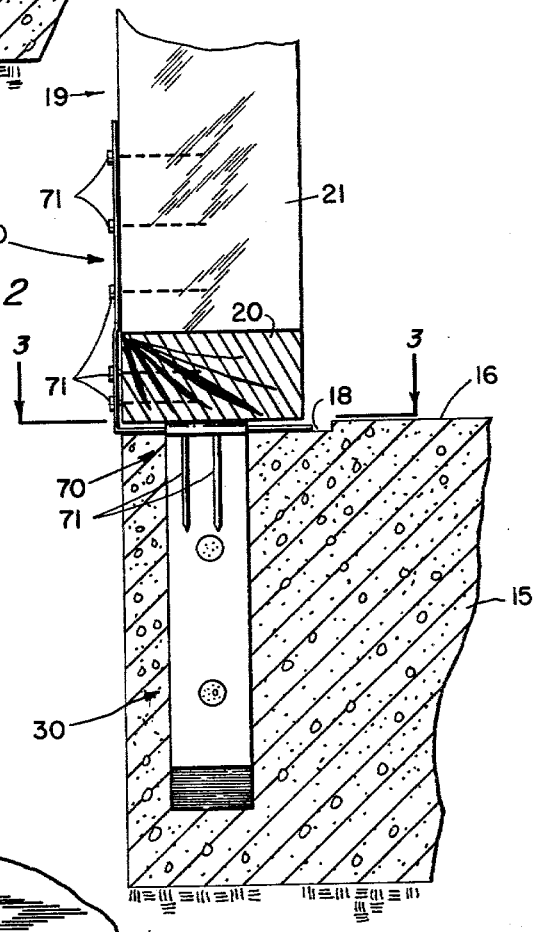
FIG. 2 is a fragmentary vertical section of the concrete foundation of FIG. 1 subsequent to setting of the concrete and showing disposition of the construction device in a second attitude wherein a wall frame is secured on the concrete foundation.

A concrete slab or foundation 15 is shown in FIGS. 1 and 2 as having been poured within the form 11. The foundation has an upper surface 16 which is substantially coplanar with the upper edge surface 12 of the form. The foundation has a lateral edge 17 formed by facing engagement with the interior side surface 14 of the form. As will hereinafter be described, a groove or channel 18 is formed in the upper surface 16 of the foundation extending from the lateral edge 17 to a position inwardly therefrom.

As shown in FIG. 2, the construction device 10 is disposed in a second attitude. A wall frame 19 is erected on the upper surface 16 of the concrete foundation 15. The wall frame is composed of a sill or horizontal piece 20 on which are mounted a plurality of upright studs, such as indicated at 21.

Figure 3:
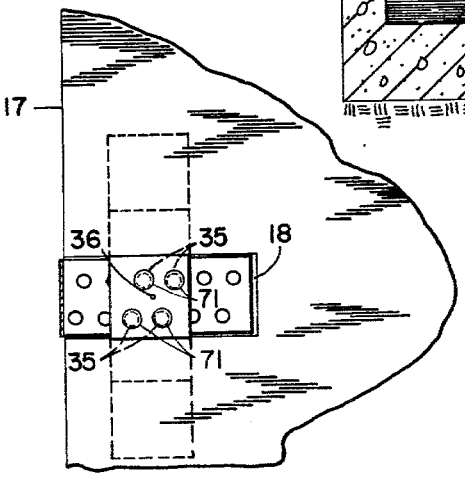
FIG. 3 is a fragmentary horizontal section taken from a position indicated by line 3—3 in FIG. 2.
Figure 4:
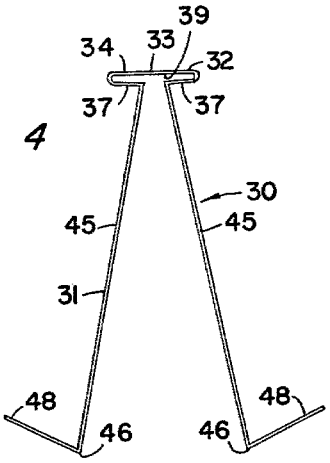
FIG. 4 is a front elevation of the anchor member of the construction device.
Figure 5:
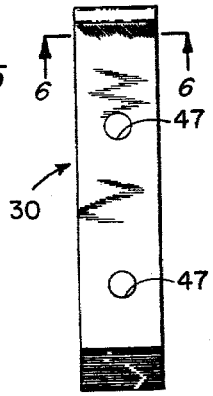
FIG. 5 is a side elevation of the anchor member.
Figure 6:
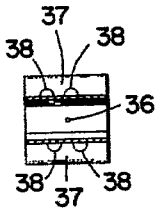
FIG. 6 is a transverse section taken on line 6—6 in FIG. 5.
Figure 7:
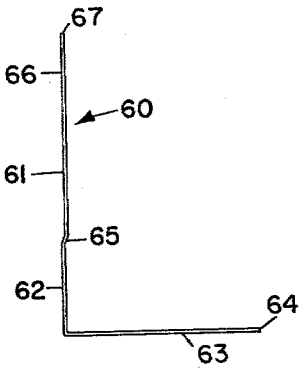
FIG. 7 is a side elevation of the fastening member of the device of the present invention.

As can best be seen in FIGS. 3, 4 and 5, the construction device 10 of the present invention has an anchor member 30. The anchor member is constructed of a rigid metal strap 31 which is bent to form the operative portions of the anchor member. The strap has a connective or head portion 32. The head portion has a central, substantially flat segment 33 having an upper surface 34. Four concrete nail holes 35 are extended through the central segment in spaced relation to each other and preferably in the pattern visible in FIG. 3. A central hole 36, preferably of somewhat smaller diameter than the holes 35, extends through the segment 33 substantially centrally thereof. The strap 31 has convergent segments 37 forming part of the head portion 32. The convergent segments each have a pair of concrete nail holes 38 extending therethrough which are individually axially aligned with a corresponding pair of the nail holes 35 of the central segment. The convergent segments and the central segment define a receptacle or slot 39 extending through the head portion substantially parallel to the upper surface 34 of the central segment.

The metal strap 31 of the anchor member 30 is individually bent at the convergent segments 37 of the head portion 32 to form divergent legs or leg portions 45 extending to remote end portions 46. Between the convergent segments 37 and the end portions 46, each leg portion has a pair of apertures 47 extending therethrough. Corresponding apertures of the leg portions are preferably aligned along axes substantially parallel to the upper surface 34 of the central segment 33 for purposes subsequently to be described. The strap 31 is bent to form lateral segments 48 individually extending outwardly from the end portions 46 of the leg portions.

Figure 8:
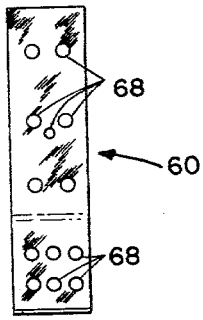
FIG. 8 is a front elevation of the fastening member.

The construction device 10, in addition to the anchor member 30, has a fastening member 60. The fastening member is preferably formed from a metal strap 61 which is bent to from the various portions of the fastening member. The fastening member thus has a central segment 62 which is dimensioned to be fitted over the upper edge surface 12 of the construction form 11, as illustrated in FIG. 1. The fastening member has a first portion or projection 63 extending substantially at right angles from the central segment to a remote end 64. The metal strap 61 of the fastening member is bent on the opposite side of the central segment from the first projection to provide an offset segment or portion 65. The fastening member has a second projection 66 integral with the offset portion and substantially parallel to the central segment 62. Thus, the second projection is substantially right-angularly related to the first projection 63. The second projection extends to a remote end 67. The fastening member has a plurality of nail holes 68 extending through the central segment 62, first projection 63 and second projection 66 thereof, as best shown in FIG. 8.

For purposes of illustrative convenience, the first attitude for the construction device 10 is indicated by the numeral 69 in FIG. 1. Similarly, the second attitude for the construction device is indicated by the numeral 70 in FIG. 2. As shown in FIGS. 1 and 2, nails 71 are employed in the use of the construction device as will subsequently be described.

OPERATION

The operation of the described embodiment of the subject invention is believed to be clearly apparent and is briefly summarized at this point. Prior to pouring of the concrete foundation 15, the construction device 10 is disposed in the first attitude 69 shown in FIG. 1. In this attitude the central segment 62 of the fastening member 60 is fitted over the upper edge surface 12 of the construction form 11 to position the first projection 63 in facing engagement with the exterior side surface 13 of the construction form. This orients the second projection 66 so as to extend inwardly from and at right angles to the interior side surface 14 of the form. One or more nails 71 are driven through the holes 68 and into the form temporarily to hold the fastening member in position. It will be noted that because of the offset portion 65 of the fastening member, the second projection is disposed slightly below the upper edge surface 12 of the form.

The head portion 32 of the anchor member 30 is slidably fitted on the second projection 66. This is accomplished by sliding the head portion about the second projection so that the second projection is received in the slot 39 with the leg portions 45 disposed below the head portion. The anchor member is positioned precisely as desired relative to the interior side surface 14 of the construction form. The anchor member is normally spaced inwardly from the interior side surface approximately one inch [2.54 cm.]. A nail 71 is then driven through the central hole 36 of the central segment 33 of the anchor member and through the desired nail hole 68 of the fastening member. This temporarily secures the anchor member in the selected position relative to the construction form. All of the construction devices employed in the operation are mounted in the first attitude in this same manner. Subsequently, concrete is poured within the form and finished in the conventional manner. There is virtually no danger of dislodging the anchor members from the desired positions during the pouring and finishing operation because they are securely mounted in position.

It will be noted that when the construction device 10 is positioned in this first attitude 69 and the concrete is poured into the form 11 to position the upper surface 16 of the concrete foundation 15 so formed substantially in coplanar relation to the upper edge surface 12 of the form, the upper surface 34 of the central segment 33 of the head portion is automatically positioned in substantially coplanar relation to the upper surface of the foundation. Similarly, since the second projection 66 is slightly below the upper surface of the form, the channel 18 is created in the foundation leading from the lateral edge 17 of the foundation to a point beyond the anchor member. The apertures 47 of the leg poritons 45 permit the concrete to flow through the leg portions so as to establish an even more positive mounting of the anchor member within the foundation. Where the anchor member is to be under unusually great upward pull, reinforcing rods, not shown, can be inserted through corresponding apertures 47 of the leg portions to offer still greater resistance to dislodging of the anchor member from the foundation. The lateral segments 48 of the leg portions offer resistance to dislodging of the anchor member from the foundation and permit the anchor member to be constructed of thinner metal. This permits reduction of the cost of the construction device to be reduced to a minimum clearly competitive with the cost of bolts conventionally used in construction.

When the concrete foundation 15 has been permitted to set sufficiently, the nails 71 are removed from the central holes 36 of the anchor members 30 and from the holes 68 of the fastening members 60. Subsequently, the form 11 and fastening members 60 are removed from the foundation to draw their respective second projections 66 from the channels 18 in the foundation while leaving the anchor members 30 permanently secured in the selected positions in the foundation. Thereafter, the fastening members 60 are removed from the form.

The fastening members 60 are then individually positioned with the first projections 63 individually slidably received and the channels 18 and slots 39 of the anchor members 30. The second projections 66 of the fastening members are disposed in the upright attitudes and positions shown in FIG. 2 appropriate for securing the wall frame 19 on the foundation. It will be seen that since the first projections 63 are effectively shorter than the second projections 66, the channels 18 are sufficiently long to accommodate virtually any adjustments of the fastening members on the foundation. When the precise positions for the fastening members are achieved, nails 71 are individually driven through the holes 35 of the central segments 33, the holes 68 of the first projections of the fastening members and the holes 38 of the convergent segments 37 and into the concrete foundation 15. This permanently affixes each fastening member in the selected upright position on the anchor member and foundation.

Subsequently, the wall frame 19 is positioned in the desired upright position on the upper surface 16 of the foundation. A suitable number of nails 71 are driven through the nail holes 68 of the central segment 62 of each fastening member into the horizontal piece 20 and through the second projection 66 into the stud 21 of the wall frame. This permanently secures the wall frame in the precise desired position on the foundation without need for drilling any holes in the frame, or laborious adjustment and readjustment of various portions of the wall frame as required with conventional devices. Since the upper surface 34 of the central segment 33 of the anchor member 30 is substantially flush with the upper surface 16 of the foundation, the anchor member does not interfere with positioning of the wall frame or any other structure mounted thereon.

Therefore, the construction device of the present invention permits the erection of wall frames, posts, pillars and the like on concrete structures such as foundations rapidly and with a precision not heretofore achieved in conventional practice while simultaneously affording a device which possesses a strength superior to that of any comparable conventional device and an adaptability to use in virtually any environment in which a work object must be anchored to a concrete structure.

Although the invention has been herein shown and described in what is conceived to be the most practical and preferred embodiment, it is recognized that departures may be made therefrom within the scope of the invention, which is not to be limited to the illustrative details disclosed.

Having described my invention what I claim as new and desire to secure by Letters Patent is:

1. A construction device for use with a support in anchoring a work object on concrete or the like, the construction device comprising an anchor member having a leg portion for embedding in concrete; means borne by the anchor member for interconnecting the anchor member and a second object; and a fastening member having first and second projections so related as to be interchangably connectable to the interconnecting means for positioning in a first attitude, with the first projection secured on said support and the second projection connected to said interconnecting means supporting the anchor member for the pouring of concrete about the leg portion thereof, and a second attitude, with the first projection connected to the interconnecting means supported by the anchor member on said concrete and the second projection extending therefrom for securing to said work object.

2. The device of claim 1 wherein the support is a concrete form having an upper edge surface substantially to which said concrete is poured and the fastening member has a portion intermediate the first and second projections dimensioned to be fitted over the upper edge surface of the form to support the second projection laterally of and a sufficient distance below said upper edge surface to form a channel in the concrete so poured leading to the interconnection means.

3. The device of claim 2 wherin the second projection is longer than the first projection so that said channel formed thereby in the concrete is longer than the first projection.

4. The device of claim 1 wherein the support is a concrete form to which said concrete is poured and the second projection is so related to the first projection as, in said first attitude, to position the second projection substantially parallel to an upper surface of the concrete to be poured with the leg portion of said anchor member spaced from the concrete form for embedding completely within the concrete so poured.

5. The device of claim 1 wherein the interconnection means includes a head portion integral with the anchor member having a slot dimensioned alternately to receive said first and second projections of the fastening member in slidable relation.

6. A construction device for use with a support in anchoring a work object on concrete or the like, the construction device comprising a bracket having substantially angularly related first and second portions; and an anchor member having a leg portion for embedding in concrete and a head portion adapted to be removably engagable on the second portion of the bracket in depending relation for the pouring of concrete about the leg portion of the anchor member with the first portion of the bracket fastened on the support and subsequently to engage the first portion of the bracket in supporting relation when the concrete has hardened for securing said work object to the second portion of the bracket.

7. A construction device for mounting a wall frame or the like on a concrete foundation in cooperation with a construction form having an upper edge surface, the device comprising an anchor member having a mounting portion, shaped to form a slot extending therethrough, and a leg portion extending from said mounting portion to an end portion remote therefrom; and a fastening member having a central portion dimensioned to be fitted on the upper edge surface of said construction form, a first projection adapted to be fastened in facing engagement with the form in a first attitude and dimensioned to be slidably received in said slot of the mounting portion of the anchor member in a second attitude, and a second projection substantially right-angularly related to the first projection and dimensioned to be slidably received in said slot of the mounting portion of the anchor member in said first attitude in supporting relation to the anchor member for the pouring of concrete about the leg portion to form the concrete foundation and adapted to be secured on the wall frame in said second attitude to mount the wall frame on the concrete foundation so formed.

8. The construction device of claim 7 wherein the slot of the mounting portion of the anchor member defines a substantially flat plane, the mounting portion has an upper surface substantially parallel to said plane of the slot, and the second projection of the fastening member is offset from the central portion thereof to position said upper surface of the mounting portion of the anchor member, in said first attitude, substantially in coplanar relation to said upper edge surface of the construction form and to form a channel in the concrete foundation so formed leading to the slot of said mounting portion.

9. A construction device for use with a support in anchoring a work object on concrete or the like, the construction device comprising a fastening member having a pair of end portions; and an anchor member having a leg and a connective portion containing a receptacle dimensioned removably to receive one of said end portions of the fastening member in a first attitude, with the other of said end portions secured on the support so as to support the anchor member in position for the pouring of concrete about the leg, and to receive one of said end portions in a second attitude, with the other of said end portions disposed for securing on said work object.

10. The construction device of claim 9 wherein said receptacle is a slot bounded by a substantially flat central segment of said connective portion of the anchor member and the slot is dimensioned slidably to receive an end portion of the fastening member beneath said central segment in each of said attitudes.

* * * * *